US009126098B2

(12) United States Patent
Trudel

(10) Patent No.: US 9,126,098 B2
(45) Date of Patent: Sep. 8, 2015

(54) RELEASABLE SNOWBOARD BINDING

(75) Inventor: Thomas A. Trudel, Stateline, NV (US)

(73) Assignee: Thomas A. Trudel, Denver, CO (US)

( * ) Notice: Subject to any disclaimer, the term of this patent is extended or adjusted under 35 U.S.C. 154(b) by 0 days.

(21) Appl. No.: 13/491,438

(22) Filed: Jun. 7, 2012

(65) Prior Publication Data

US 2012/0313350 A1 Dec. 13, 2012

(51) Int. Cl.

| | |
|---|---|
| ***A63C 9/00*** | (2012.01) |
| ***A63C 10/12*** | (2012.01) |
| ***A63C 10/04*** | (2012.01) |
| *A63C 10/24* | (2012.01) |

(52) U.S. Cl.

CPC ..... *A63C 10/12* (2013.01); *A63C 10/04* (2013.01); *A63C 10/24* (2013.01)

(58) Field of Classification Search

CPC ..... A63C 9/088; A63C 9/083; A63C 9/0805; A63C 9/0846; A63C 10/04; A63C 10/12; A63C 10/24; A63C 10/06; A43C 11/14

USPC ..... 280/14.22, 611, 622, 623, 624, 626, 280/633, 634

See application file for complete search history.

(56) References Cited

U.S. PATENT DOCUMENTS

| | | | | |
|---|---|---|---|---|
| 2,803,467 | A * | 8/1957 | Von Opel | 280/611 |
| 4,361,344 | A * | 11/1982 | Hull et al. | 280/613 |
| 5,145,202 | A * | 9/1992 | Miller | 280/613 |
| 5,156,644 | A * | 10/1992 | Koehler et al. | 280/14.23 |
| 5,188,387 | A | 2/1993 | Ruffinengo | |
| 5,294,144 | A * | 3/1994 | Stepanek et al. | 280/612 |
| 5,362,087 | A * | 11/1994 | Agid | 280/611 |
| 5,609,347 | A * | 3/1997 | Dressel | 280/14.23 |
| 5,727,797 | A | 3/1998 | Bowles | |
| 5,820,155 | A * | 10/1998 | Brisco | 280/607 |
| 6,007,086 | A * | 12/1999 | Hopkins | 280/612 |
| 6,024,375 | A * | 2/2000 | Johnson | 280/601 |
| 7,104,564 | B2 * | 9/2006 | Martin et al. | 280/625 |
| 7,841,614 | B2 * | 11/2010 | Damiani et al. | 280/611 |
| 8,065,819 | B2 * | 11/2011 | Kaufman | 36/50.1 |
| 8,403,354 | B2 * | 3/2013 | Senner et al. | 280/623 |
| 8,499,474 | B2 * | 8/2013 | Kaufman | 36/50.1 |
| 2001/0002518 | A1 * | 6/2001 | Morrow et al. | 36/118.8 |
| 2005/0167950 | A1 * | 8/2005 | Martin et al. | 280/618 |
| 2007/0090627 | A1 | 4/2007 | Laurent | |
| 2009/0152835 | A1 * | 6/2009 | Cunningham et al. | 280/631 |
| 2009/0212534 | A1 | 8/2009 | Mercat et al. | |
| 2009/0223084 | A1 * | 9/2009 | Kaufman | 36/43 |

FOREIGN PATENT DOCUMENTS

| | | | |
|---|---|---|---|
| WO | 2012170935 | A2 | 12/2012 |
| WO | 2012170935 | A3 | 2/2013 |

OTHER PUBLICATIONS

International Search Report and Written Opinion in corresponding International Patent Application PCT/US12/41730 dated Dec. 18, 2012, 9 pages.

* cited by examiner

*Primary Examiner* — Hau Phan
*Assistant Examiner* — Jacob Meyer

(57) ABSTRACT

A releasable snowboard binding includes a strap release mechanism adapted to be coupled to a binding strap, a spatial orientation detector, and a strap release actuator coupled to the strap release mechanism and configured to actuate the strap release mechanism in response to a spatial orientation detected by the spatial orientation detector. The snowboard binding is coupled between a strap and a binding frame.

17 Claims, 13 Drawing Sheets

RELEASABLE SNOWBOARD BINDING

RELATED APPLICATIONS

The present application claims priority to U.S. Provisional Application Ser. No. 61/520,499, filed Jun. 10, 2011.

BACKGROUND

1. Field of the Invention

The present invention generally relates to snowboard bindings. More specifically, the present invention relates to a snowboard binding system that has releasable binding straps.

2. Description of the Related Art

FIG. 1 illustrates an isometric view of the two styles of traditional snowboard binding systems: a strap-in binding 10 and a step-in binding 30.

A traditional strap-in snowboard binding 10 consists of a binding chassis 12, a mounting plate 14, a highback 16, and one or more binding straps 18 held together by strap buckles 20. Snowboards that are equipped with strap-in snowboard bindings do not require specialized boots. A binding chassis 12 is the binding frame and provides the primary structural support for the snowboard binding. A mounting plate 14 provides interface between the binding chassis and the snowboard. A highback 16 provides additional support and hinges on the binding chassis 12. A highback 16 rises above the user's heel, thereby increasing control and stability of the snow board. The one or more binding straps 18 and strap buckles 20 cross over the top of the boot. Traditionally, there is an ankle strap and toe strap, although other orientations exist. The strap buckles 20 are fastened to each half of the one or more binding straps 18. The user's boot is held inside the snowboard binding by the one or more straps 18 with varying amounts of force depending on how tightly the user fastens the strap buckles 20. Each end of the one or more binding straps 18 is fastened to the binding chassis 12 via screws or other fasteners.

A traditional step-in snowboard binding 30 consists of a binding chassis 32, a mounting plate 34, a highback 36, and a clip-in mechanism 38. A binding chassis 32 is the binding frame and provides the primary structural support for the snowboard binding. A mounting plate 34 provides interface between the binding chassis and the snowboard. A highback 36 provides additional support and hinges on the binding chassis 32. A highback 36 rises above the user's heel, thereby increasing control and stability of the snowboard. The clip-in mechanism 38 holds the user's boot inside the binding chassis 32 and highback 36. Snowboards that are equipped with step-in snowboard bindings do require specialized boots that are compatible with the step-in snowboard bindings. A traditional step-in binding uses a spring loaded clip-in mechanism 38 that includes spring loaded metal clips, housed within the binding chassis 32 and mounting plate 34, that latch on to rigid metal clips on the bottom of the boot. The clip-in mechanism 38 is manufactured with a maximum amount of tension in the springs, allowing for occasional release of the boot under high levels of stress. However, the clip-in mechanism 38 contains no system for release of the boot when the board is inverted or at rest. Additionally, some forms of a step-in binding utilize only a mounting plate 34 and clip-in mechanism 38, and do not include a binding chassis 32 or a highback 36. The additional required support is provided in the structure of the specialized boot.

Currently, neither strap-in bindings nor step-in bindings allow for the automatic release of the boot from the binding under certain conditions, especially when the snowboard user cannot reach the snowboard bindings to release the boots. Because the snowboard user may need his boots to be released from the snowboard to avoid danger or entrapment, there is a need for a binding system that allows for the automatic release of the boot from the snowboard binding under certain circumstances.

SUMMARY OF THE INVENTION

A releasable snowboard binding includes a strap release mechanism adapted to be coupled to a binding strap, a spatial orientation detector, and a strap release actuator coupled to the strap release mechanism and configured to actuate the strap release mechanism in response to a spatial orientation detected by the spatial orientation detector. The snowboard binding is coupled between a strap and a binding frame.

Various embodiments of the invention include embodiments where the spatial orientation detector is integrated with the strap release mechanism, and embodiments where the spatial orientation detector is not integrated with the strap release mechanism.

BRIEF DESCRIPTION OF THE DRAWINGS

Features of the invention are further disclosed in the following detailed description, referencing the following drawings, in which.

DETAILED DESCRIPTION

Persons of ordinary skill in the art will realize that the following description of the present invention is illustrative only and not in any way limiting. Other embodiments of the invention will readily suggest themselves to such skilled persons.

Figure 1:
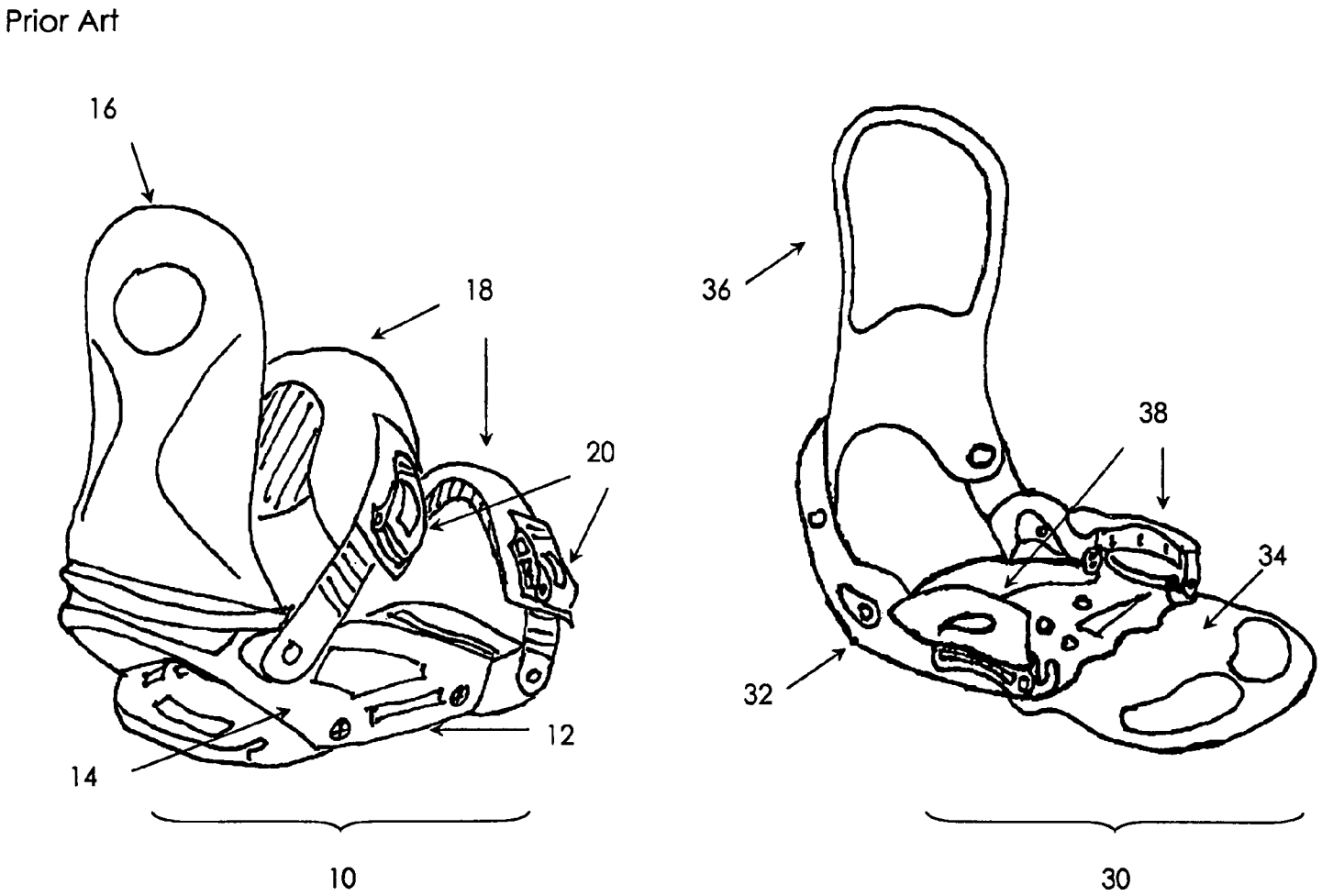
FIG. 1 illustrates an isometric view of a typical prior art strap-in snowboard binding and a typical prior art step-in snowboard binding and their respective primary components.
Figure 2:
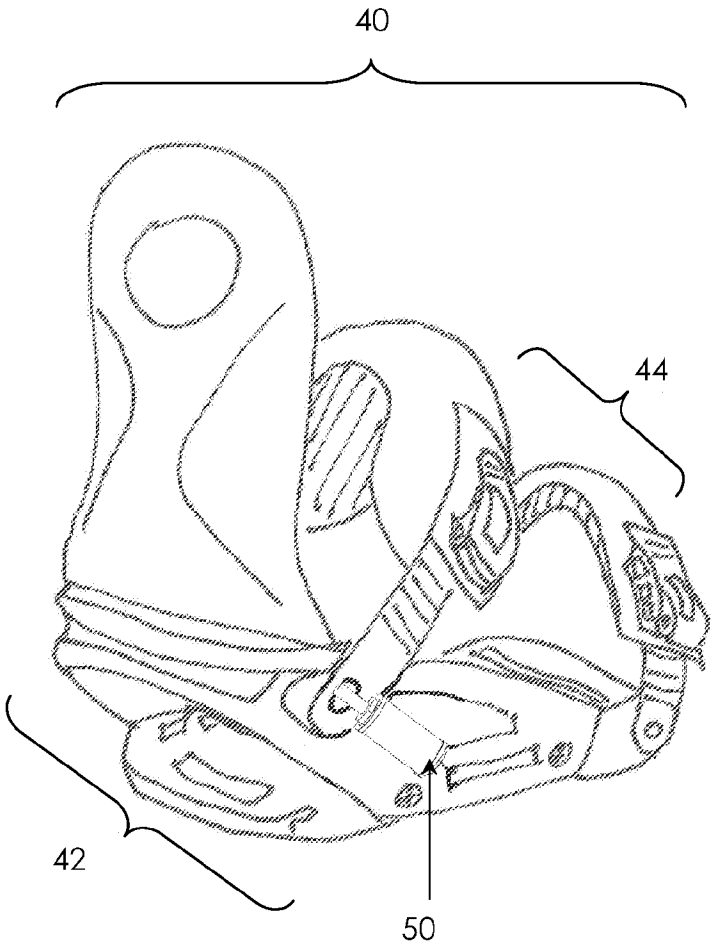
FIG. 2 illustrates an isometric view of an exemplary snowboard binding with releasable binding straps, according to the present invention.

Referring now to FIG. 2, a diagram illustrates an isometric view of an exemplary snowboard binding 40 with releasable binding straps according to the present invention. The snowboard binding 40 includes a binding frame 42 and at least one strap 44. The strap 44 is coupled to the binding frame 42 through an integrated strap release mechanism 50. The strap release mechanism 50 is mounted to the boot so that both it and the boot are in an upright position.

Figure 3C:
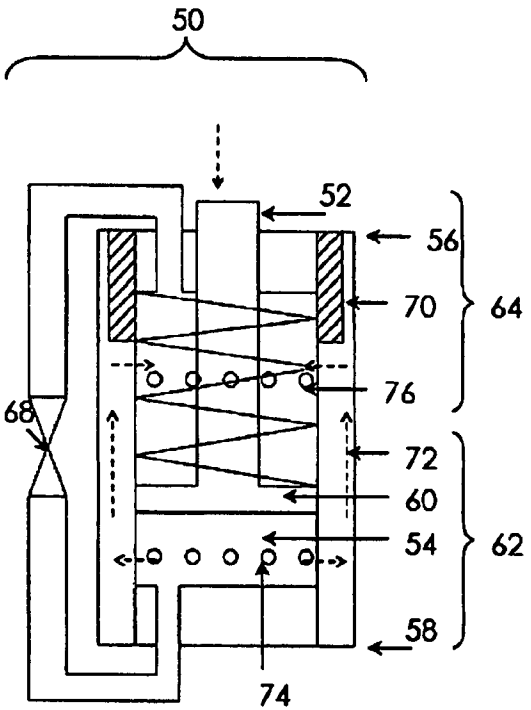
FIGS. 3A, 3B and 3C illustrate an embodiment according to an aspect of the present invention, namely, an integrated strap release mechanism with a manual selection valve.
Figure 3B:
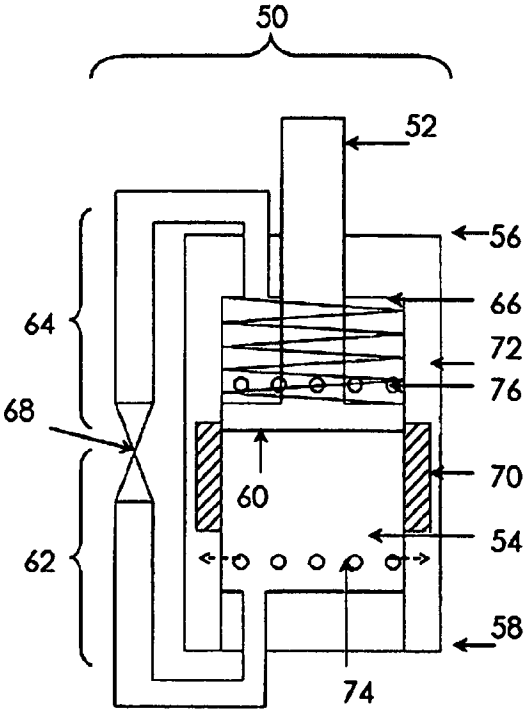
Figure 3A:
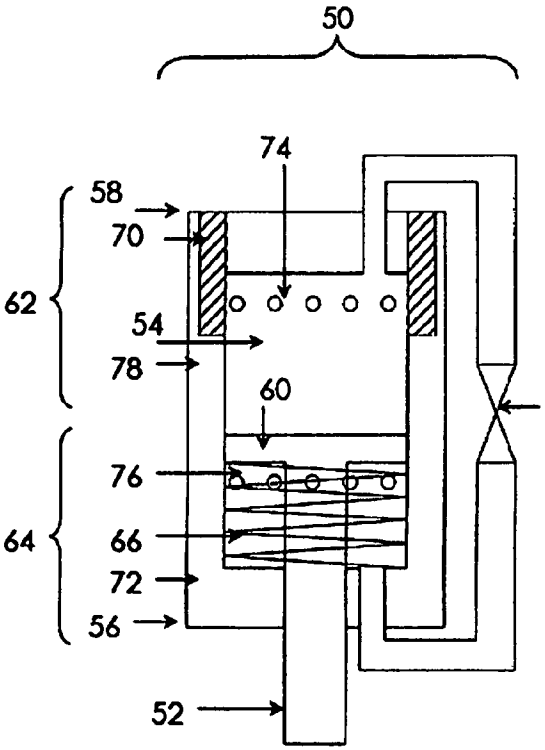

The operation of the strap release mechanism 50 can be easily understood with reference to FIGS. 3A, 3B, and 3C. Referring now to FIG. 3*a*, a diagram shows a cross-sectional view of an illustrative embodiment according to one aspect of the present invention disposed in an upright position. The actuator 52 is coupled to the integrated strap release mechanism 50. The actuator 52 is translatable between a closed position, wherein a boot is held in the binding by the strap 44, and an open position, wherein the boot is not held in the binding by the strap 44 and is releasable. The strap release mechanism includes two concentric cylinders. The inner cylinder 54 has a first end 56 and a second end 58, and is filled with a fluid. A piston 60, disposed in the inner cylinder 54 is coupled to the actuator 52 and is movable along an axial direction in the inner cylinder 54. The piston 60 defines a first volume 62 and a second volume 64 in the inner cylinder 54 and is biased towards the second end 58 of the inner cylinder 54 by a spring 66 to position the actuator 52 in the open position that minimizes the first volume 62.

A manual valve 68 is coupled between the first end 56 and second end 58 of the inner cylinder 54. The manual valve 68 has an open position and a closed position. When the manual valve 68 is in the open position, the fluid in the inner cylinder 54 can flow freely between the first volume 62 and the second volume 64, allowing the actuator 52 to be manually moved from closed to open position, or vice versa.

An annular float 70 is disposed in the volume defined between the outer wall of the inner cylinder 54 and the inner wall of the outer cylinder 72 and is configured to easily move up and down therein.

When the snowboard binding 40 is in an upright position (e.g., when the snowboard user is riding the snowboard), the position of the annular float 70 is as shown in FIG. 3A. Inside the outer cylinder 72, the annular float 70 is held in position by buoyancy. The buoyancy of the float 70 may be altered by varying the viscosity of the fluid and the density of the float material. The inner cylinder 54 includes a lower set of peripheral apertures, one of which is labeled 74, and an upper set of peripheral apertures, one of which is labeled 76. The apertures are shown in dashed lines in the diagrams in FIGS. 3A, 3B, and 3C because, as will be readily appreciated by persons having knowledge in the art, the apertures are out of the plane through which the cross-section is taken.

In the position illustrated in FIG. 3A (e.g., when the snowboard is upright), the float 70 covers the lower set of peripheral apertures 74, forcing the fluid to stay within the first volume 62 of the inner cylinder 54 because the piston cannot move in a downward direction, thus holding the actuator 52 in the closed position, wherein the boot is held in the binding by the strap.

Referring now to FIG. 3B, a diagram in which the strap release mechanism 50 is shown in an upside-down position (e.g., when the snowboard is turned upside-down), the buoyancy of the annular float 70 causes it to rise through the outer cylinder 72, uncovering the lower set of peripheral apertures 74.

When the snowboard binding 40 is oriented between an angle greater than about 90° and less than about 270° from an upright reference position of about 0°, the annular float 70 moves at a rate that is dependent on damping. The closer the orientation of the snowboard binding 40 is to 180°, the faster the annular float 70 moves and the faster the lower set of peripheral apertures 74 open. Thus, the damping of the annular float 70 is angle-dependent.

When buoyancy causes the annular float 70 to rise, the lower set of peripheral apertures 74 are opened. The fluid moves out of the inner cylinder 54 through the lower set of peripheral apertures 74, into the outer cylinder 72.

When the float 70 has risen above the upper set of peripheral apertures 76, illustrated by FIG. 3C, the fluid is allowed to flow through the lower peripheral apertures 74 to the outer cylinder 72 from the first volume 62 of the inner cylinder 54 and back into the second volume 64 of the inner cylinder 54 through the upper set of peripheral apertures 76.

The existence of a fluid flow path between the first and second volumes 62 and 64 of the inner cylinder 54 allows the spring 66 to push the piston 60 to the lower end of the inner cylinder 54, which moves the actuator 52 from the closed position to the open position. The actuator 52 triggers the integrated strap release mechanism 50, thereby releasing strap 44 and allowing the boot to be removed from the snowboard binding 40.

A "locked" setting may be utilized by the snowboard user whereby a physical stop 78 is manually engaged (FIG. 3A). The physical stop 78 prevents the float 70 from moving from through the outer cylinder 72. Thus, the integrated strap release mechanism 50 is disengaged in the "locked" setting.

In accordance with one embodiment of the present invention, the float 70 is flush with the outer wall of the inner cylinder 54, but is not flush with the inner wall of the outer cylinder 72. In accordance with another embodiment of the present invention, the apertures 74 or 76 are holes, which are flared or rimmed outwardly from the wall of the inner cylinder 54.

Figure 4A:
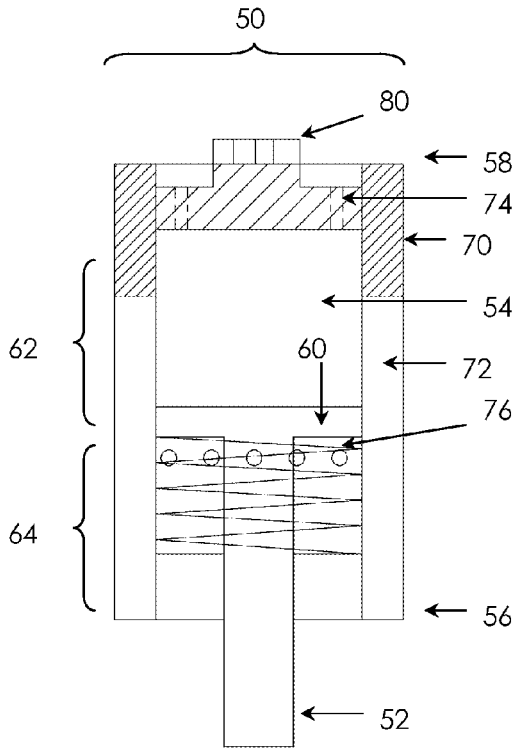
FIGS. 4A, 4B, 4C and 4D illustrate an alternate embodiment according to an aspect of the present invention, namely, an integrated strap release mechanism with a manual selection valve.
Figure 4C:
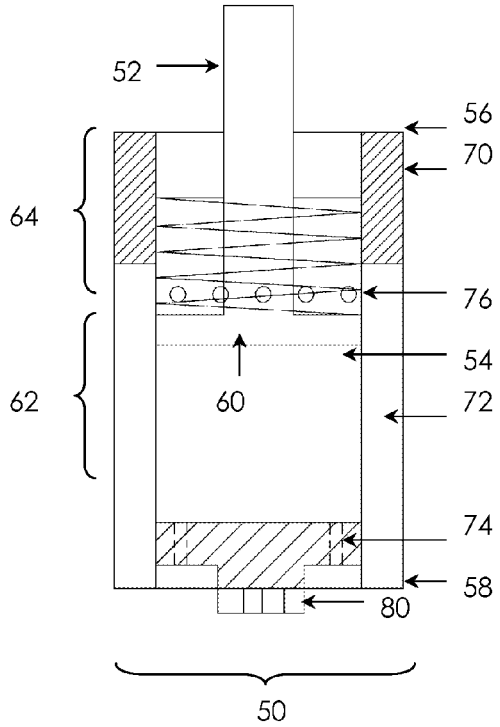
Figure 4B:
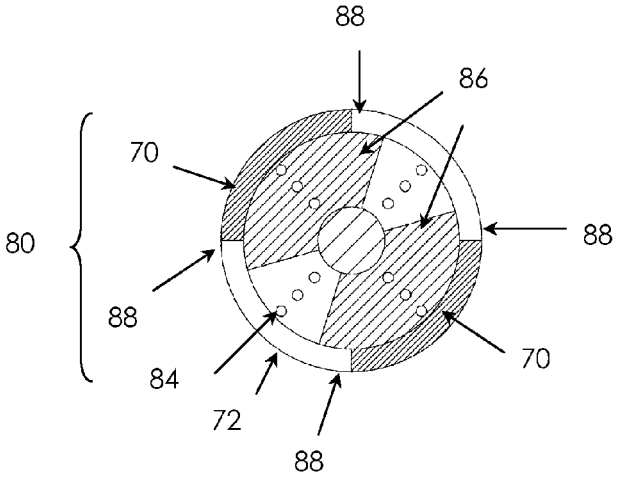

Referring now to FIGS. 4A, 4B, and 4C, diagrams show an illustrative embodiment according to another aspect of the present invention that is similar to the embodiment shown in FIGS. 3A, 3B, and 3C. To the extent that the elements in this embodiment are the same as the corresponding elements in the embodiment shown in FIGS. 3A, 3B, and 3C, the same reference numerals will be used.

Referring now to FIG. 4A, a cross-sectional view of strap release mechanism 50, the actuator 52 is coupled to the strap release mechanism 50. The actuator 52 is translatable between a closed position, wherein a boot is held in the binding by the strap 44, and an open position, wherein the boot is not held in the binding by the strap 44 and is releasable. The strap release mechanism includes two concentric cylinders. The inner cylinder 54 has a first end 56 and a second end 58, and is filled with a fluid. A piston 60, disposed in the inner cylinder 54, is coupled to the actuator 52 and is movable along an axial direction in the inner cylinder 54. The piston 60 defines a first volume 62 and a second volume 64 in the inner cylinder 54 and is biased towards the second end of the inner cylinder 54 to position the actuator 52 in the open position that minimizes the first volume 62.

A manual selection valve 80 is coupled to the second end 58 of the inner cylinder 54. Referring now to FIG. 4B, a diagram illustrates a bottom view of the release mechanism 50, including the manual selection valve 80. In an illustrative embodiment, the space between the inner cylinder 54 and the outer cylinder 72 is partitioned into four sections by walls 88 that run axially within this space. Two of the four sections house the float and correspond to the timer apertures 84. Two of the four sections are empty and correspond to fill apertures 82.

The manual selection valve 80 has solid fins 86 that cover or uncover the fill apertures 82 and timer apertures 84 to provide the selected setting. The manual selection valve 80 has a "fill" setting, a "locked" setting, and a "timer" setting.

When the manual selection valve 80 is in the fill position, as illustrated by FIG. 4B, selection valve fins 86 cover the timer apertures 84 and uncover the fill apertures 82. The fluid in the inner cylinder 54 moves freely out of the fill apertures 82 between the first volume 62 and the second volume 64, allowing the actuator 52 to be moved from closed to open position, or vice versa.

When the manual selection valve 80 is in the locked position, the selection valve fins 86 cover both the fill apertures 82 and the timer apertures 84, and no fluid can flow between the first volume 62 and the second volume 64. Thus, the actuator cannot move.

When the manual selection valve 80 is in the timer position, selection valve fins 86 cover the fill apertures 82 and uncover the timer apertures 84.

An float 70 is disposed in the volume defined between the outer wall of the inner cylinder 54 and the inner wall of the outer cylinder 72 and is configured to easily move up and down therein.

When the snowboard binding 40 is in an upright position (e.g., when the snowboard user is riding the snowboard), the position of the float 70 is as shown in FIG. 4A. Inside the outer cylinder 72, the float 70 is held in position by buoyancy. The buoyancy of the float 70 may be altered by varying the viscosity of the fluid and the density of the float material. The inner cylinder 54 includes a lower set of peripheral apertures, one of which is labeled 74, and an upper set of peripheral apertures, one of which is labeled 76. The apertures are shown in dashed lines in the diagrams in FIGS. 4A, 4B, and 4C because, as will be readily appreciated by persons having knowledge in the art, the apertures are out of the plane through which the cross-section is taken.

In the position illustrated in FIG. 4A (e.g., when the snowboard is upright), the float 70 covers the lower set of peripheral apertures 74, forcing the fluid to stay within the first volume 62 of the inner cylinder 54 because the piston cannot move in a downward direction, thus holding the actuator 52 in the closed position, wherein the boot is held in the binding by the strap.

Referring now to FIG. 4C, a diagram in which the strap release mechanism 50 is shown in an upside-down position (e.g., when the snowboard is turned upside-down), the buoyancy of the float 70 causes it to rise through the outer cylinder 72, uncovering the lower set of peripheral apertures 74.

When the snowboard binding 40 is oriented between an angle greater than about 90° and less than about 270° from an upright reference position of about 0°, the annular float 70 moves at a rate that is dependent on damping. The closer the orientation of the snowboard binding 40 is to 180°, the faster the annular float 70 moves and the faster the lower set of peripheral apertures 74 open. Thus, the damping of the annular float 70 is angle-dependent.

When buoyancy causes the float 70 to rise, the lower set of peripheral apertures 74 are opened. The fluid moves out of the inner cylinder 54 through the lower set of peripheral apertures 74, into the outer cylinder 72.

When the float 70 has risen above the upper set of peripheral apertures 76, the fluid is allowed to flow through the lower peripheral apertures 74 to the outer cylinder 72 from the first volume 62 of the inner cylinder 54 and back into the second volume 64 of the inner cylinder 54 through the upper set of peripheral apertures 76.

The existence of a fluid flow path between the first and second volumes 62 and 64 of the inner cylinder 54 allows the spring 66 to push the piston 60 to the lower end of the inner cylinder 54, which moves the actuator 52 from the closed position to the open position. The actuator 52 triggers the integrated strap release mechanism 50, thereby releasing strap 44 and allowing the boot to be removed from the snowboard binding 40.

In accordance with one embodiment of the present invention, the float 70 is flush with the outer wall of the inner cylinder 54, but is not flush with the inner wall of the outer cylinder. In accordance with another embodiment of the present invention, the apertures 74 or 76 are holes, which are flared or rimmed outwardly from the wall of the inner cylinder 54.

Figure 4D:
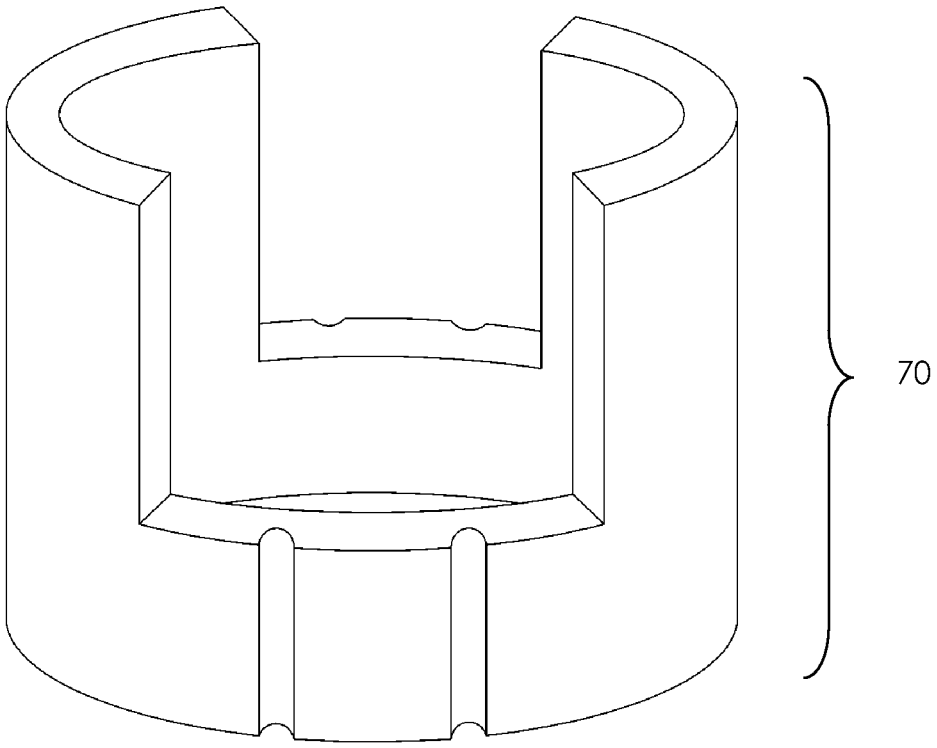

Referring now to FIG. 4D, an isometric view of an illustrative embodiment of the float 70 is shown. Float 70 in FIG. 4D is shown including a plurality of bypass flutes to maintain a flow path for the fluid around the float.

Figure 5:
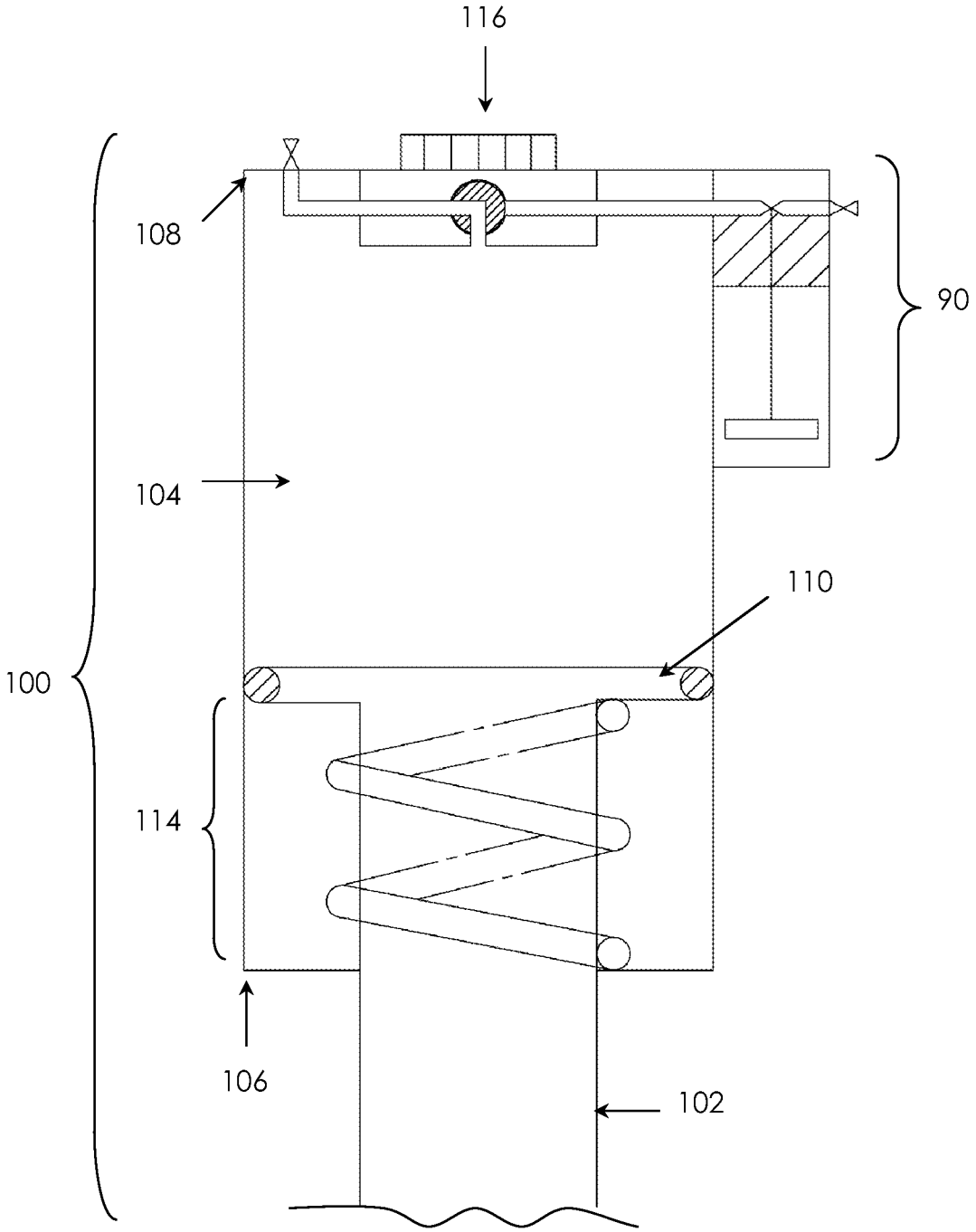
FIG. 5 illustrates an alternate embodiment according to an aspect of the present invention, namely, a non-integrated strap release mechanism.

Referring now to FIG. 5, a diagram shows a cross-sectional view of another embodiment according to another aspect of the present invention. A spatial orientation detector 90 is coupled to a strap release mechanism 100. An actuator 102 is coupled to the strap release mechanism 100. The actuator 102 is translatable between a closed position, wherein a boot is held in the binding by the strap 44, and an open position, wherein the boot is not held in the binding by the strap 44 and is releasable. The non-integrated strap release mechanism 100 contains one cylinder 104. The cylinder 104 has a first end 106 and a second end 108, and is filled with a fluid. A piston 110, disposed in the cylinder 104 is coupled to the actuator 102 and is movable along an axial direction in the cylinder 104. The piston 110 defines a first volume 112 and a second volume 114 in the cylinder 104 and is biased to the second end of the cylinder 104 to position the actuator 102 in the open position that minimizes the first volume 112.

Figure 6B:
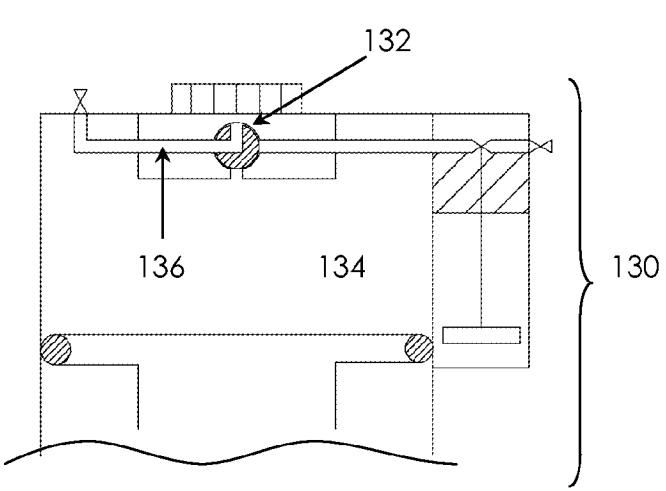
FIGS. 6A, 6B, and 6C illustrate an alternate embodiment according to an aspect of the present invention, namely, the settings of a mode-selecting valve on the non-integrated strap release mechanism.
Figure 6A:
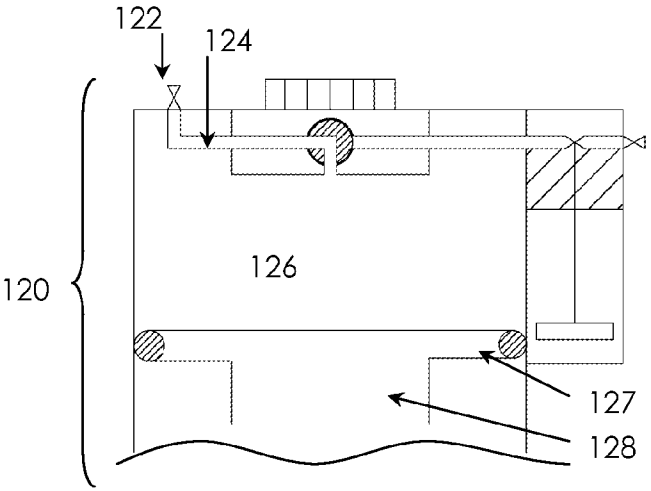
Figure 6C:
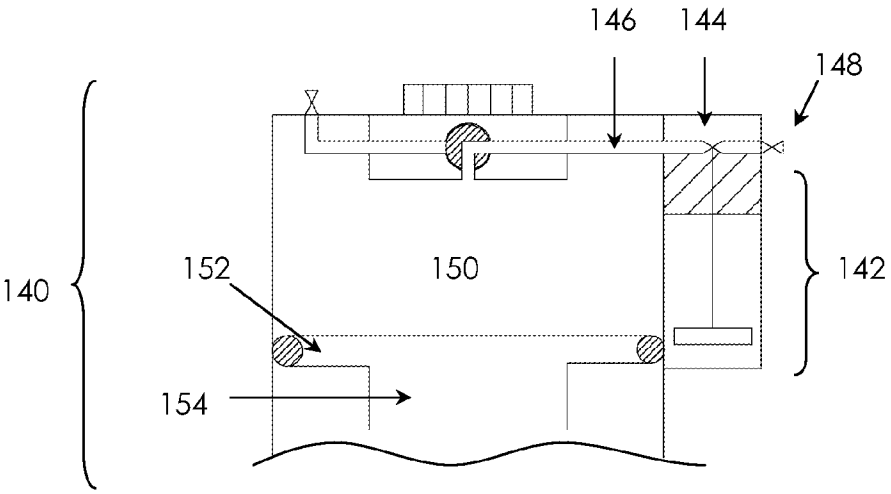

A mode-selecting valve 116 coupled to the strap release mechanism 100 has a "fill" setting, a "locked" setting, and a "release" setting, illustrated by FIGS. 6A, 6B, and 6C, respectively.

Referring now to FIG. 6A, a diagram illustrates a cross-sectional view of the "fill" setting of the strap release mechanism 120. The one-way fill valve 122 allows fluid to enter the sleeve 124, and fill the volume of the cylinder 126 above piston 127. The fluid builds pressure in the cylinder 124 behind the piston 127. The actuator is freely moveable when the "fill" setting is engaged. When the "fill" setting is disengaged, the fluid is confined in the cylinder 126 and the pressure of the fluid in the cylinder 124 behind the piston 127 will prevent the actuator 128 from moving in an upward direction.

Referring now to FIG. 6B, a diagram illustrates a cross-sectional view of the "locked" setting of the non-integrated strap release mechanism 130. The one-way valve 132 is closed, preventing fluid from escaping from the cylinder 134. Thus, the strap release mechanism 130 is disengaged in the "locked" setting.

Referring now to FIG. 6C, a diagram illustrates a cross-sectional view of the "release" setting of the non-integrated strap release mechanism 140. A path to the needle valve 144 is created for fluid in the cylinder 124. When the spatial orientation detector 142 is turned upside down, the float opens the valve shaft, causing the needle valve 144 to open and the fluid leaves the spatial orientation detector 142 through the sleeve 146. The fluid travels into the one-way drain valve 148 and leaves the non-integrated strap release mechanism 100. As the fluid drains, the pressure in the cylinder 150 behind the piston 152 is relieved. The spring 154 expands and pushes the piston 152 to trigger the actuator 154, which releases the strap.

Figure 7B:
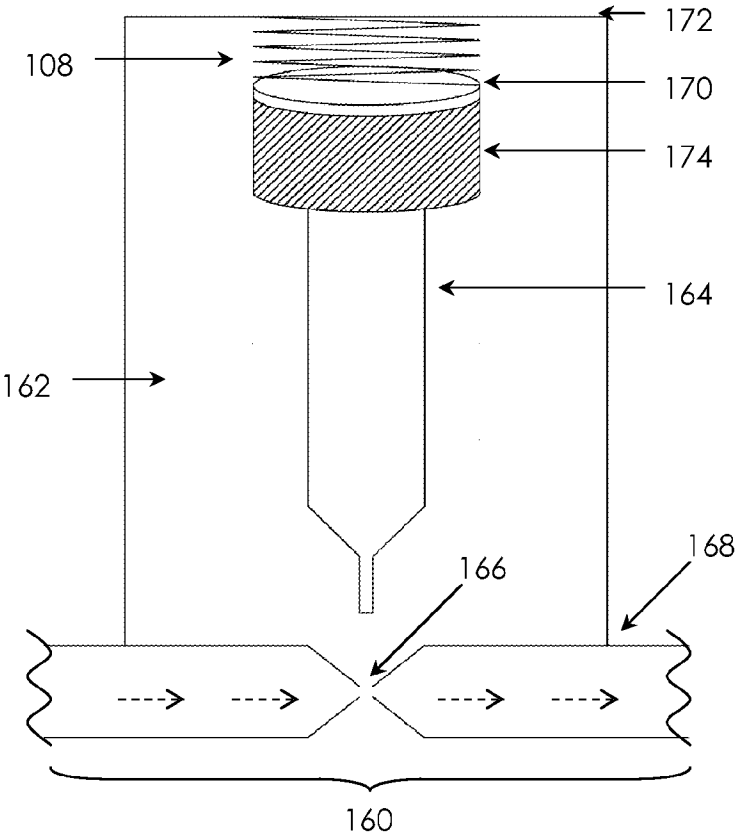
FIGS. 7A and 7B illustrate one embodiment according to an aspect of the present invention, namely, a spatial orientation detector with a spring and float balance.
Figure 7A:
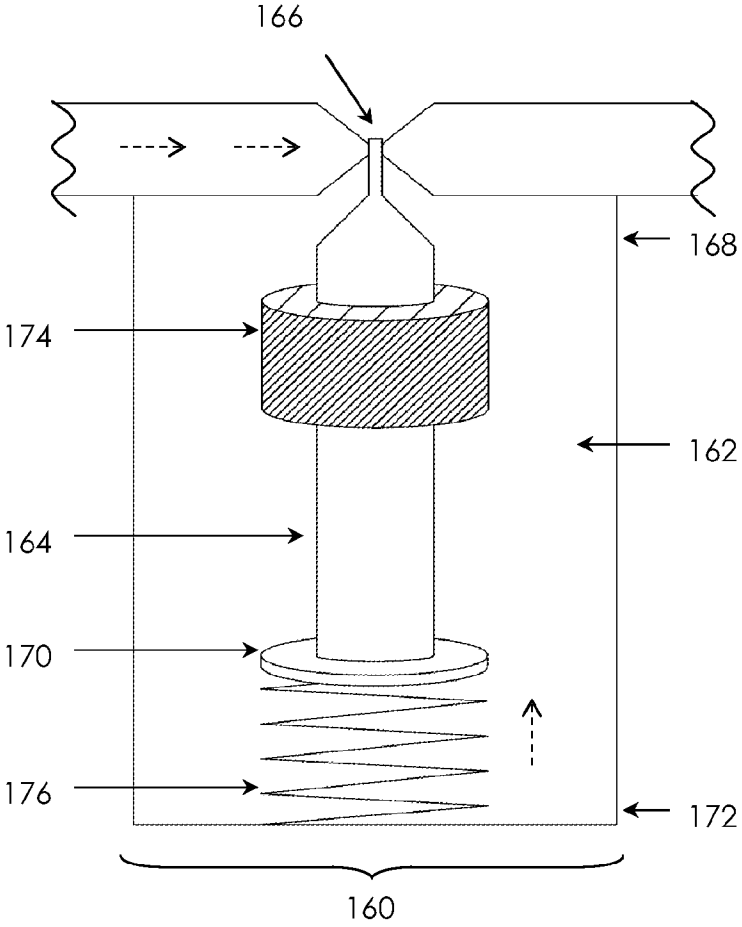
Figure 8B:
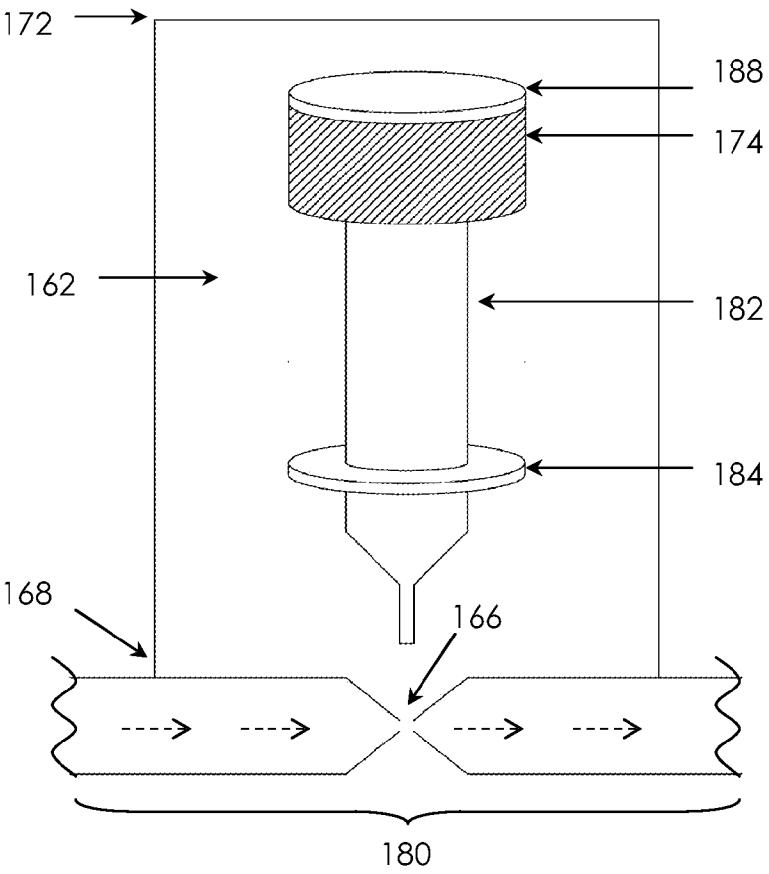
FIGS. 8A and 8B illustrate an alternate embodiment according to another aspect of the present invention, namely, a spatial orientation detector with a float and a needle shaft with two stops.
Figure 8A:
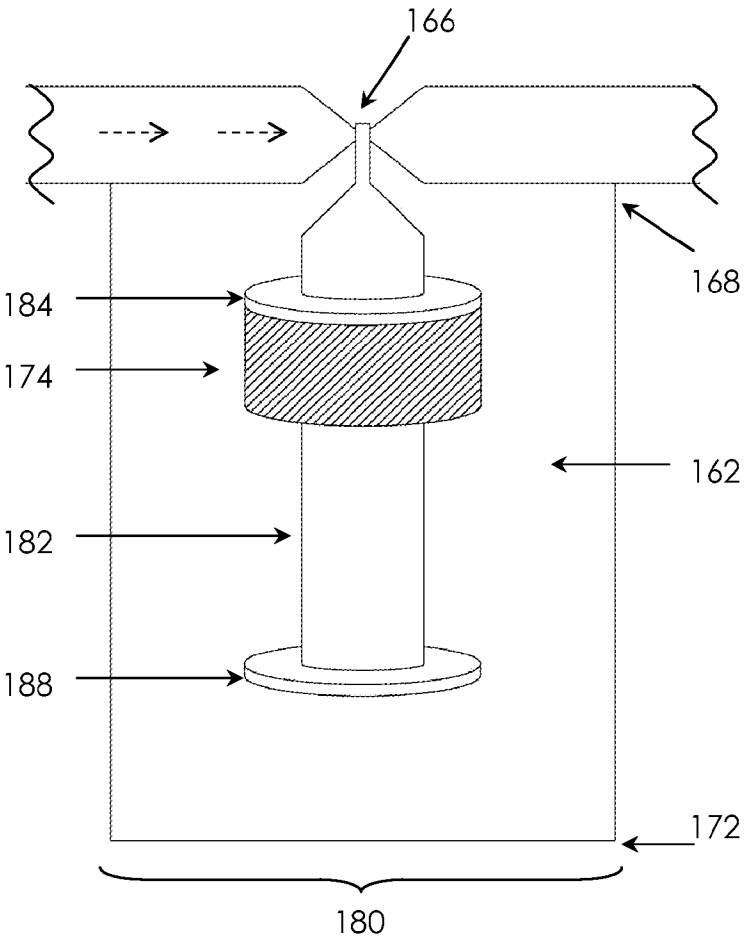

Referring to FIGS. 7, 8, and 9, each show a diagram of a cross-sectional view of several embodiments of a spatial orientation detector, such as is employed in the embodiment of FIGS. 5 and 6A-6C. FIGS. 7, 8, and 9 illustrate how the spatial orientation detector is engaged during the "release" setting of FIG. 6C. The embodiments vary slightly, but to the extent that the elements are the same, the same reference numerals will be used.

Referring now to FIG. 7, a diagram shows a cross-sectional view of another embodiment according to another aspect of the present invention, namely, a spatial orientation detector with a spring 176 and float balance 160. Disposed in the cylinder 162 is a needle valve shaft 164 terminating at a needle valve 166 at a first end 168 and a float stop 170 at a second end 172. An annular float 174 is disposed in the volume defined between the inner wall of the cylinder 162 and the outer surface of the needle valve shaft 164, and is movable along an axial direction in the cylinder 162.

When the snowboard binding is right-side up (e.g., when the snowboard user is riding the snowboard), the annular float 174 is near the first end 168, as shown in FIG. 7 A. Inside the cylinder 162, the spring 176 expands, pushing the needle valve shaft 164 into position to close the needle valve 166.

When the snowboard is turned upside-down, because of its buoyancy, the annular float 174 begins to move to the second end 172 of the cylinder 162, as shown in FIG. 7B. The annular float 174 pushes against the float stop 170, which compresses the spring 176 and pulls the needle valve shaft 164 toward the second end 172 of the cylinder 162 and the needle valve 166 opens, allowing fluid to travel through it. Persons of ordinary skill in the art will immediately recognize that the buoyancy of float 174 and the spring constant of spring 176 are chosen together to achieve an operable device.

When the snowboard binding is oriented between an angle greater than about 90° and less than about 270° from an upright reference position of about 0°, the annular float 174 moves at a rate that is dependent on damping. The closer the orientation of the snowboard binding 40 is to 180°, the faster the annular float 174 moves and the faster the needle valve 166 opens to allow fluid to flow through it. Thus, the damping of the annular float 174 is angle-dependent.

Referring now to FIG. 8, a diagram shows a cross-sectional view of another embodiment according to another aspect of the present invention, namely, a spatial orientation detector with a float and a needle shaft with two float stops 180. Disposed in the cylinder 162 is a needle valve shaft 182 terminating at a needle valve 166, and having a first float stop 184 at the first end 168 of the cylinder 162 and a second float stop 188 at the second end 172 of the cylinder 162. An annular float 174 is disposed in the volume defined between the inner wall of the cylinder 162 and the outer surface of the needle valve shaft 164, and is movable along an axial direction in the cylinder 162.

When the snowboard binding 40 is in an upright position (e.g., when the snowboard user is riding the snowboard), the buoyancy of the annular float 174 urges it towards the first end 168, as shown in FIG. SA. The annular float 174 pushes against float stop 184, forcing the needle valve shaft 182 into position to close the needle valve 166.

When the snowboard is turned upside-down, because of its buoyancy, the annular float 174 begins to rise to the second end 172 of the cylinder 162, as shown in FIG. 8B. The annular float 174 pushes against the float stop 188, which pulls the needle valve shaft 182 toward the second end 172 of the cylinder 162 and the needle valve 166 opens, allowing fluid to travel through it.

When the snowboard binding is oriented between an angle greater than about 90° and less than about 270° from a reference position of about 0°, the annular float 174 rises at a rate that is dependent on its buoyancy and damping caused by the viscosity of the fluid. The closer the orientation of the snowboard binding 40 is to 180°, the faster the annular float 174 rises and the faster the needle valve 166 opens to allow fluid to flow through it. Thus, the rising speed, and thus delay timing of the annular float 174 is angledependent.

Referring now to FIG. 9, a diagram shows a cross-sectional view of another embodiment according to another aspect of the present invention, namely, a spatial orientation detector with a float fixed on a needle shaft 190.

Disposed in the cylinder 162 is a needle valve shaft 192 terminating at a needle valve 166 at a first end, and terminating at a float 194 at a second end.

Figure 9B:
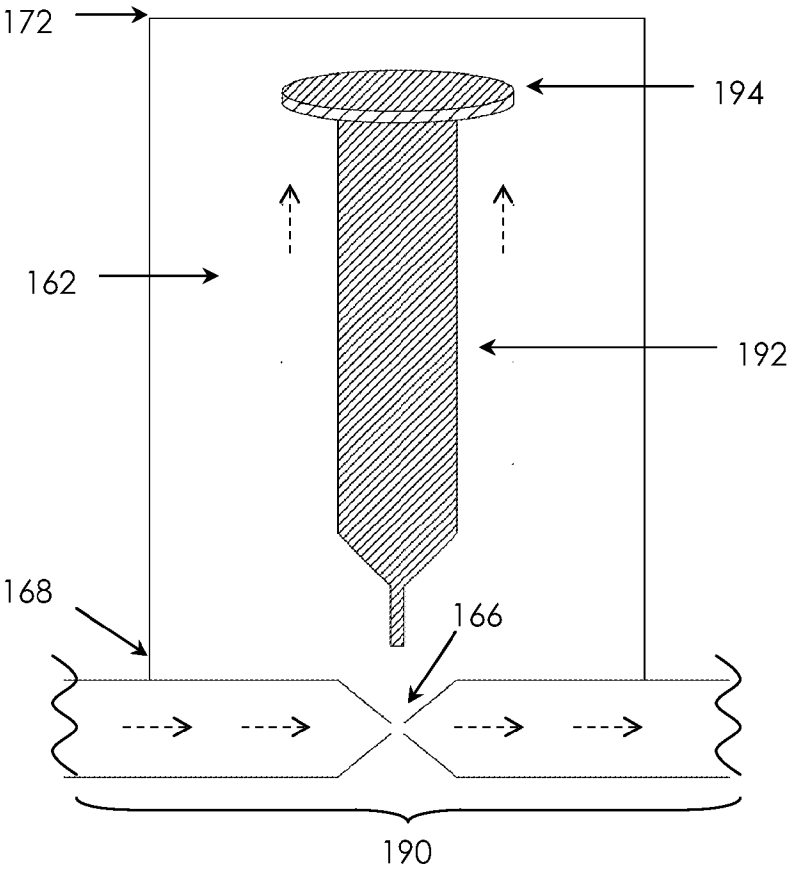
FIGS. 9A and 9B illustrate an alternate embodiment according to another aspect of the present invention, namely, a spatial orientation detector with a float fixed on a needle shaft.
Figure 9A:
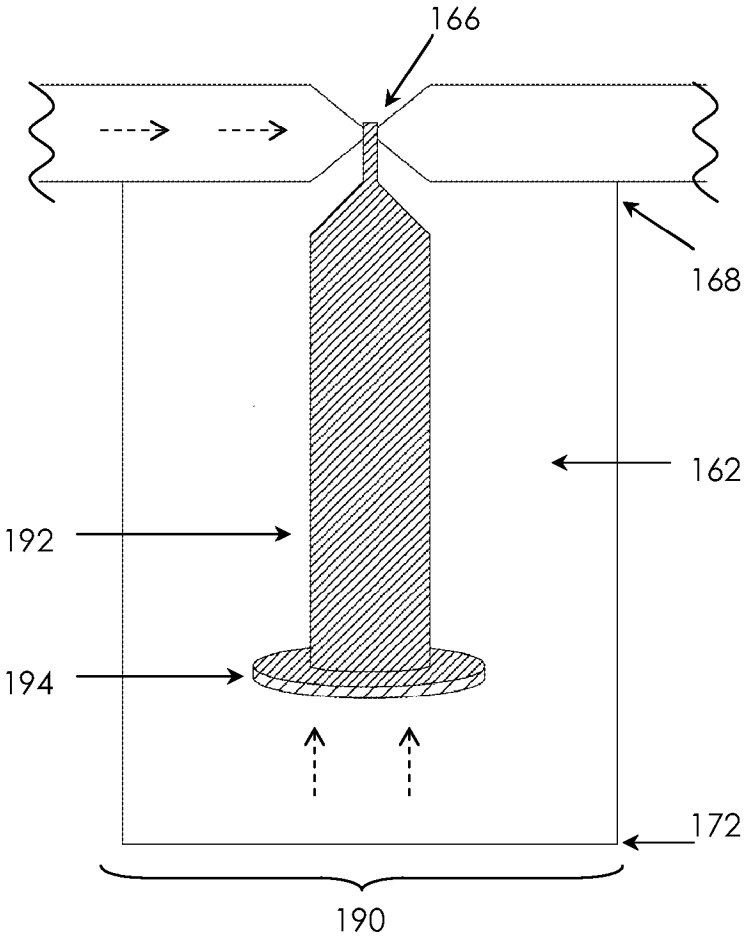

When the snowboard binding 40 is in an upright position (e.g., when the snowboard user is riding the snowboard), the buoyancy of the annular float 194 urges it towards the second end 172 of the cylinder 162, as shown in FIG. 9A. The float 194 pushes the needle valve shaft 192 toward the first end 168 of the cylinder 162, forcing the needle valve shaft 192 into position to close the needle valve 166.

When the snowboard is turned upside-down, because of its buoyancy, the float 194 begins to rise to the second end 172 of the cylinder 162, as shown in FIG. 9B. The float 194 pushes the needle valve shaft toward the second end 172 of the cylinder 162 and the needle valve 166 opens, allowing fluid to travel through it.

When the snowboard binding is oriented between an angle greater than about 90° and less than about 270° from an upright reference position of about 0°, the annular float 174 rises at a rate that is dependent on its buoyancy and damping caused by the viscosity of the fluid. The closer the orientation of the snowboard binding 40 is to 180°, the faster the annular float 174 rises and the faster the needle valve 166 opens to allow fluid to flow through it. Thus, the rising speed, and thus delay timing of the annular float 174 is angle-dependent.

In the embodiments illustrated in FIGS. 3-9, it is envisioned that the float may be replaced by a sink. Persons of ordinary skill in the art will readily appreciate that FIGS. 3-9, turned upside-down, illustrate use of a sink instead of a float in the present invention.

In the embodiments illustrated in FIGS. 3-9, the fluid filling the cylinders may be any oil of any viscosity that together with the buoyancy of the float, cause the float to rise through the cylinder.

In the embodiments illustrated in FIGS. 3-9, seals such as o-rings may be employed to seal the piston against the cylinder walls.

Figure 10C:
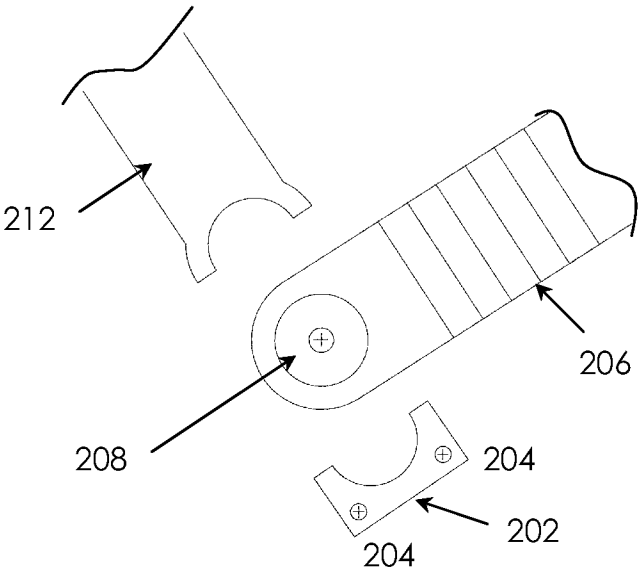
FIG. 10 illustrates an embodiment according to an aspect of the present invention, namely, a pronged mounting interface.
Figure 10B:
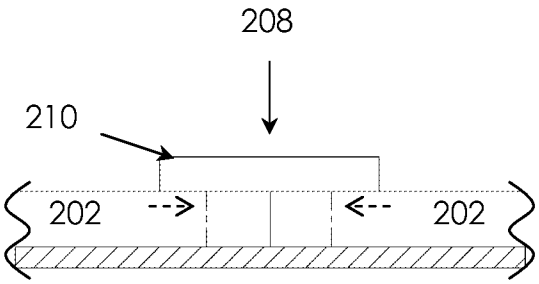
Figure 10A:
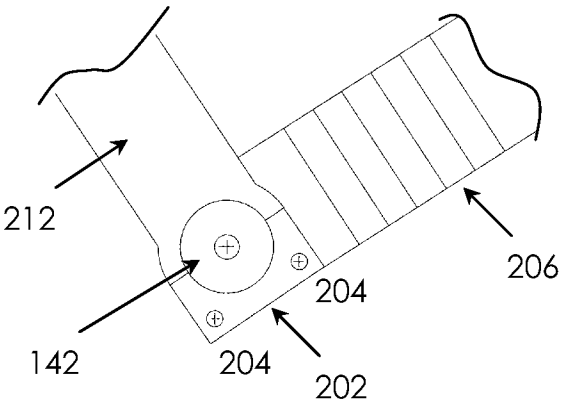

Referring to FIG. 10*a*, a strap release mechanism according to another aspect of the present invention is shown. A mounting interface 200 consists of a binding mounting point 202 with fasteners 204. A binding strap 206 is coupled to a mounting cylinder 208. A mechanism mounting point 212 is attached to the actuator of the release mechanism (e.g., the release mechanism 50 of FIGS. 3 and 4, the release mechanism 100 of FIGS. 5 and 6). Referring now to FIG. 10*b*, the mounting cylinder 208 may include flanges 210 (see FIG. 10*b*). Referring again to FIG. 10*a*, when the release mechanism is not activated (e.g., the boot is being held in the binding), the prongs of the mechanism mounting point 212 and the binding mounting point 202 meet around the mounting cylinder 208 and underneath the flanges 210. When the release mechanism is activated, as shown in FIG. 10*c*, the prongs of the mechanism mounting point 212 and the binding mounting point 202 separate and release the strap, which allows the boot to separate from the binding.

Figure 11A:
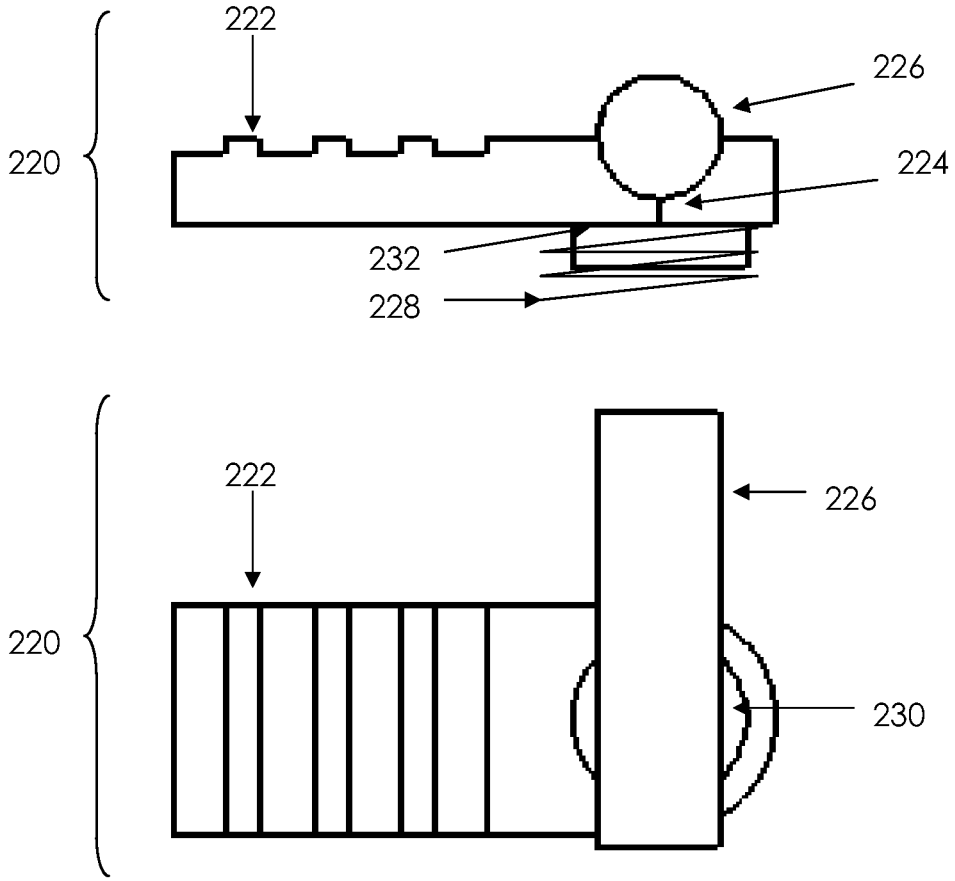
FIG. 11A illustrates an embodiment of a mounting interface including an axially or radially mounted actuator according to an aspect of the present invention.

Referring now to FIG. 11A, another illustrative embodiment according to another aspect of the present invention is shown. A mounting interface 220 consists of a binding strap 222 with a concave depression 224. The convex surface of an actuator 226 of the release mechanism (e.g., the release mechanism 50 of FIGS. 3 and 4, the release mechanism 100 of FIGS. 5 and 6) is mounted radially to the concave opening 224. When the release mechanism is not activated (e.g., the boot is being held in the binding), the actuator 226 is disposed across the strap 222 and is seated in depression 224. When the release mechanism is activated, the actuator 226 translates away from the depression 224, releasing the strap 222 and allowing the boot to separate from the binding.

As an optional feature of the embodiment illustrated in FIG. 11A, a spring 228 may be placed beneath the binding strap 222, which will create pressure under the strap 222 when the actuator 226 is dismounted from the opening 224. With this feature, the strap 222 may be released from the binding more quickly than without the spring 228.

As an optional feature of the embodiment illustrated in FIG. 11A, the actuator 226 may be mounted axially to the concave opening 224 of the binding strap 222.

Figure 11B:
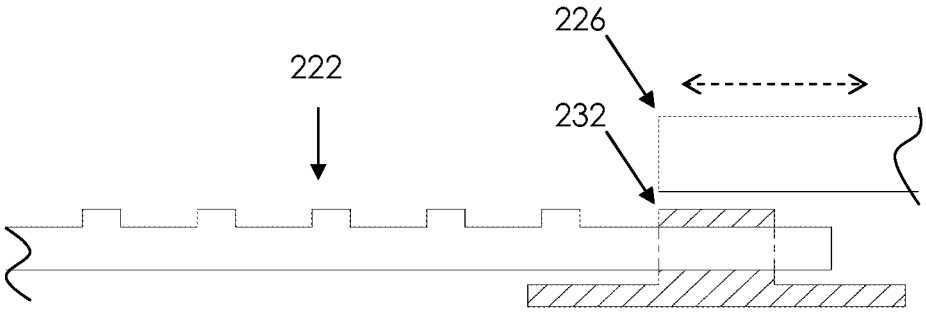
FIG. 11B illustrates another embodiment of a mounting interface including an axially or radially mounted actuator according to an aspect of the present invention.

Referring now to FIG. 11B, another illustrative embodiment according to another aspect of the present invention is shown. A mounting interface 220 consists of a binding strap 222 with a hole 230 formed at one end instead of the concave depression 224 of FIG. 11A. The hole in strap 222 is mounted over a stud 232 on the binding frame and the actuator is positioned over the end of the stud 232 to hold the strap 222 on the stud 232.

As another optional feature of the embodiment illustrated in FIG. 11B, the mounting stud 232 may have angled walls.

In embodiments illustrating an integrated release mechanism, the release mechanism must be placed vertically on either side of one or more binding straps.

In embodiments illustrating a non-integrated release mechanism and spatial orientation detector, the release mechanism may be placed vertically, horizontally, or at an angle on either side of one or more binding straps, provided that the spatial orientation detector is placed in a location on the snowboard that allows it to function as designed, for example, vertically on the highback of the binding.

It is envisioned that the components of the present invention will be constructed from any of a number of lightweight materials, including, but not limited to, 6061 aluminum, 2024 aluminum, high density plastic (e.g., ultra high molecular weight polyethylene or ultra high density polyethylene), or PVC derivatives.

While embodiments and applications of this invention have been shown and described, it would be apparent to those skilled in the art that many more modifications than mentioned above are possible without departing from the inventive concepts herein. The invention, therefore, is not to be restricted except in the spirit of the appended claims.

What is claimed is:

1. A releasable snowboard binding comprising:
- a binding frame;
- a strap coupled to the frame;
- a strap release mechanism;
- a spatial orientation detector; and
- a strap release actuator coupled to the strap release mechanism and configured to actuate the strap release mechanism in response to a spatial orientation detected by the spatial orientation detector.

2. The releasable snowboard binding of claim 1 wherein the strap is coupled to the frame through the strap release mechanism.

3. The releasable snowboard binding of claim 1 wherein:
- the spatial orientation detector includes:
  - a chamber filled with a fluid;
  - a float disposed in the chamber;
  - a valve actuator mechanically coupled to the float; and the release mechanism includes:
  - a cylinder filled with a working fluid;
  - a piston disposed in the cylinder biased in a first position and movable to a second position by pressure exerted by the working fluid; and
  - an actuator coupled to the piston and to the strap release mechanism.

4. A releasable snowboard binding comprising:
- a binding frame;
- a strap coupled to the binding frame;
- a strap release mechanism coupled to the strap;
- an actuator coupled to the strap release mechanism and translatable between a closed position wherein a boot is held in the binding by the strap and an open position wherein the boot is not held in the binding by the strap;
- a cylinder having a first end and a second end, the cylinder filled with a fluid;
- a piston coupled to the actuator and disposed in the cylinder and movable along an axial direction in the cylinder, the piston defining a first volume and a second volume in the cylinder and biased towards the second end of the cylinder to position the actuator in the open position that minimizes the first volume;
- a manual valve coupled to the second volume of the cylinder; and
- a damped gravity-actuated release valve having angle-dependent damping coupled between the first volume and the second volume of the cylinder, the release valve having an open position and a closed position and configured to open at orientations between an angle greater than about 90° and less than about 270° from a reference position of about 0°.

5. The releasable snowboard binding of claim 4, wherein the manual valve is a bypass valve coupled between the first volume and the second volume of the cylinder.

6. A strap release mechanism for a releasable snowboard binding comprising:
- a strap release mechanism configured to be coupled to a snowboard binding strap;
- spatial orientation detector; and
- a strap release actuator coupled to the strap release mechanism and configured to actuate the strap release mechanism in response to a spatial orientation detected by the spatial orientation detector.

7. A strap release mechanism for a releasable snowboard binding comprising:
- a strap release mechanism configured to be coupled to a strap;
- an actuator coupled to the strap release mechanism and translatable between a closed position wherein a boot is held by the strap and an open position wherein the boot is not held by the strap;
- a cylinder having a first end and a second end, the cylinder filled with a fluid;

a piston coupled to the actuator and disposed in the cylinder and movable along an axial direction in the cylinder, the piston defining a first volume and a second volume in the cylinder and biased towards the second end of the cylinder to position the actuator in the open position that minimizes the first volume;

a manual valve coupled to the second volume of the cylinder; and a damped gravity-actuated release valve having angle-dependent damping coupled between the first volume and the second volume of the cylinder, the release valve having an open position and a closed position and configured to open at orientations between an angle greater than about 90° and less than about 270° from a reference position of about 0°.

8. The strap release mechanism of claim 7, wherein the damped gravity-actuated release valve comprises:

a needle valve communicating with the first volume of the cylinder, the needle valve having a needle mechanically coupled to a needle shaft; and a float disposed in an enclosure containing a damping fluid and coupled to the needle shaft so as to move the needle to open the valve when the enclosure is in a position corresponding to orientations between an angle greater than about 90° and less than about 270° from a reference position of about 0°.

9. The strap release mechanism of claim 8, wherein the float is disposed around the needle shaft and opens the valve by engaging a first float stop disposed on the shaft.

10. The strap release mechanism of claim 9, wherein the needle shaft is biased to maintain the needle valve in a closed position.

11. The strap release mechanism of claim 9, wherein the needle shaft is biased to maintain the needle valve in a closed position by a second float stop disposed on the shaft.

12. The strap release mechanism of claim 8, wherein the float is integral with the needle shaft.

13. A strap release mechanism for a releasable snowboard binding comprising:

a strap release mechanism configured to be coupled to a strap;

an actuator coupled to the strap release mechanism and translatable between a closed position wherein a boot is held by the strap and an open position wherein the boot is not held by the strap;

a first cylinder defined by a wall and having a first end and a second end;

a second cylinder defined by a wall and having a first end and a second end, disposed within the first cylinder so as to define an annular volume between walls of the first and second cylinders;

a piston coupled to the actuator and disposed in the second cylinder and movable along an axial direction in the second cylinder, the piston defining a first volume and a second volume in the second cylinder and biased towards the second end of the second cylinder to position the actuator in the open position that minimizes the first volume;

a manual valve coupled between the first volume and the second volume of the second cylinder;

at least one float disposed in the annular volume;

at least one first aperture disposed in the wall of the second cylinder at a height such that it is blocked by the at least one float when the at least one float is positioned in the annular volume at the second end of the first cylinder; and at least one second aperture disposed in the wall of the second cylinder at a height such that it is exposed when the at least one float is positioned in the annular volume at the first end of the first cylinder.

14. The strap release mechanism of claim 13, wherein the at least one float is an annular float having a pair of opposed tabs extending upward therefrom.

15. The strap release mechanism of claim 14, wherein the at least one second aperture is formed in an end wall of the second cylinder proximate to the second end of the first cylinder.

16. The strap release mechanism of claim 15, further including a valve positionable to obstruct the flow path of fluid through the at least one second aperture.

17. The strap release mechanism of claim 16, further including at least one third aperture formed in the end wall of the second cylinder and spaced apart from the at least one second aperture, and wherein the valve is positionable to obstruct the flow path of fluid through at least one of the at least one second and at least one third aperture.

* * * * *